US006752452B2

(12) United States Patent
Choi et al.

(10) Patent No.: US 6,752,452 B2
(45) Date of Patent: Jun. 22, 2004

(54) TWO-POSITION COLLAPSIBLE RECLINING CHAIR

(75) Inventors: Sang B. Choi, Xiamen (CN); Ho Sik Byun, Xiamen (CN)

(73) Assignee: NorthPole Ltd (HK)

( * ) Notice: Subject to any disclaimer, the term of this patent is extended or adjusted under 35 U.S.C. 154(b) by 66 days.

(21) Appl. No.: 09/969,979

(22) Filed: Sep. 29, 2001

(65) Prior Publication Data

US 2002/0043822 A1 Apr. 18, 2002

Related U.S. Application Data

(63) Continuation-in-part of application No. 09/791,320, filed on Feb. 23, 2001.

(60) Provisional application No. 60/239,022, filed on Oct. 4, 2000.

(51) Int. Cl.[7] ..... A47C 4/00

(52) U.S. Cl. ..... 297/16.2; 297/21; 297/22; 297/48

(58) Field of Search ..... 297/16.1, 16.2, 297/29, 35, 40, 41, 46, 47, 48, 52, 58, 27, 68, 45, 21, 22

(56) References Cited

U.S. PATENT DOCUMENTS

| | | | | | |
|---|---|---|---|---|---|
| 647,171 | A | | 4/1900 | Wiles | |
| 1,693,349 | A | * | 11/1928 | Rastetter | |
| 1,727,115 | A | * | 9/1929 | Rastetter | |
| 2,015,335 | A | | 9/1935 | Blumenthal | 155/117 |
| 2,467,909 | A | | 4/1949 | Rechler | 155/163 |
| 2,705,043 | A | * | 3/1955 | Hoven | |
| 3,485,528 | A | | 12/1969 | Kramer | 297/45 |
| 3,851,914 | A | | 12/1974 | Nii | 291/45 |
| 3,977,721 | A | | 8/1976 | Peterson | 297/45 |
| 4,146,269 | A | | 3/1979 | Beckley | 297/440 |
| 4,184,711 | A | | 1/1980 | Wakimoto | 297/16 |
| 4,251,107 | A | | 2/1981 | Sato | 297/19 |
| 4,273,379 | A | | 6/1981 | Borichevsky | 297/56 |
| 4,350,388 | A | | 9/1982 | Weiner | 297/284 |
| 4,437,700 | A | | 3/1984 | Elaschuk | 297/45 |
| 4,526,423 | A | | 7/1985 | Meinershagen et al. | 297/440 |
| 4,547,015 | A | | 10/1985 | Wakimoto | 297/16 |
| 4,605,261 | A | | 8/1986 | Lee | 297/16 |
| 4,635,998 | A | * | 1/1987 | Hickey | 297/31 |
| 4,671,566 | A | | 6/1987 | Knapp | 297/16 |
| 4,684,278 | A | | 8/1987 | Rauschenberger | 403/84 |
| 4,772,068 | A | * | 9/1988 | Gleckler et al. | 297/39 |
| 4,784,436 | A | | 11/1988 | Sutherland | 297/440 |
| 4,801,176 | A | | 1/1989 | Wolberg | 297/44 |
| 4,810,033 | A | | 3/1989 | Kemmann | 297/284 |
| 4,889,383 | A | | 12/1989 | Jones | 297/16 |
| 4,925,242 | A | | 5/1990 | Harris et al. | 297/284 |
| 5,015,038 | A | | 5/1991 | Mrotz | 297/457 |
| 5,054,848 | A | * | 10/1991 | Liu | 297/39 |
| 5,082,324 | A | | 1/1992 | Harada et al. | 297/83 |
| 5,110,183 | A | | 5/1992 | Jeanes, III | 297/343 |
| 5,496,094 | A | | 3/1996 | Schwartzkopf et al. | 297/45 |

(List continued on next page.)

*Primary Examiner*—Peter M. Cuomo
*Assistant Examiner*—Stephen Vu
(74) *Attorney, Agent, or Firm*—IPLO

(57) ABSTRACT

A collapsible reclining chair (10, 100, 200), has a frame assembly (16) which includes angled frame members (32), the upper ends (37) of the angled frame members (32) being pivotally attached to upper connectors (136,138), and the lower ends (36) being pivotally attached to feet (30). The frame assembly (16) as a whole expands outwardly from a central area (8). The frame assembly (16) also includes upright members (34), and a support surface (18), having a back portion (15). The lower ends (38) of each of the upright members (34) are attached to one of the angled members (32) by a reversible joint (39), so that the reclining chair (10, 100, 200) is movable from an upright position (12) when the reversible joints (39) are in a first position, to a reclining position (14) when the reversible joints (39) have been reversed to a second position.

34 Claims, 14 Drawing Sheets

U.S. PATENT DOCUMENTS

| | | | | | |
|---|---|---|---|---|---|
| 5,536,063 | A | | 7/1996 | Cable | 297/16.2 |
| 5,641,197 | A | | 6/1997 | Springmann | 297/188.11 |
| 5,735,570 | A | * | 4/1998 | Tseng | 297/39 |
| 5,813,721 | A | | 9/1998 | Arcidiacono | 297/16.1 |
| D401,075 | S | * | 11/1998 | Smith | D6/366 |
| 5,882,068 | A | | 3/1999 | Levine | 297/21 |
| 5,893,605 | A | | 4/1999 | Chang | 297/188.14 |
| 5,961,178 | A | | 10/1999 | Hodson | 297/17 |
| 5,975,626 | A | | 11/1999 | Ayocock | 297/16.1 |
| 5,984,406 | A | | 11/1999 | Lee | 297/16.2 |
| 5,988,750 | A | | 11/1999 | Rubottom | 297/350 |
| D421,192 | S | * | 2/2000 | White | D6/368 |
| 6,045,177 | A | | 4/2000 | Grace | 297/45 |
| 6,106,056 | A | * | 8/2000 | Wegner | 297/16.1 |
| D432,325 | S | | 10/2000 | Zheng et al. | D6/368 |
| D432,823 | S | | 10/2000 | Zheng | D6/500 |
| D433,244 | S | | 11/2000 | Zheng | D6/367 |
| D433,574 | S | | 11/2000 | Zheng | D6/368 |
| 6,170,907 | B1 | | 1/2001 | Tsai | 297/16.1 |
| 6,209,958 | B1 | | 4/2001 | Thole | 297/302.1 |
| 6,231,119 | B1 | | 5/2001 | Zheng | 297/16.2 |
| 6,237,993 | B1 | | 5/2001 | Zheng | 297/16.2 |
| 6,241,311 | B1 | | 6/2001 | Zheng | 297/45 |
| 6,247,748 | B1 | | 6/2001 | Zheng | 297/16.2 |
| 6,276,757 | B1 | | 8/2001 | Brown | 297/353 |
| 6,296,304 | B1 | | 10/2001 | Zheng | 297/45 |
| 6,302,479 | B1 | | 10/2001 | Zheng | 297/16.2 |

* cited by examiner

TWO-POSITION COLLAPSIBLE RECLINING CHAIR

This application is a Continuation-In-Part claiming priority from pending application Ser. No. 09/791,320 filed Feb. 23, 2001 and also claims priority from U.S. Provisional Application Serial No. 60/239,022, filed Oct. 4, 2000.

TECHNICAL FIELD

The present invention relates generally to portable furniture used in recreational activities, and more particularly to camping chairs.

BACKGROUND ART

Reclining chairs provide a restful opportunity for the user to "put their feet up" at the end of a long work day without the necessity of providing a foot stool, or other prop which may take up floor space unnecessarily when not in use. By having a foot rest built into the chair, the amount of discrete pieces of furniture in a room may be reduced.

Users may wish to enjoy the comforts of a reclining chair in an outdoor setting, perhaps on a back porch, or by a pool. As traditional reclining chairs are generally too heavy for easy portability, there have been certain types of folding chairs developed which may include foot rests. Some of these may fold down flat, with a hinged portion which allows a back portion to be inclined, perhaps at a variety of angles. One familiar style was the "deck chair" covered with either a canvas or plastic mesh surface and with a frame structure including notches on the backs of the rear legs into which a cross-bar may fit to retain a certain inclination angle.

This type of structure has the disadvantage that the cross-bar may become dislodged from the notches, in which case the back may fall unimpeded to the horizontal position, startling or even injuring the user. The older style of deck chair is also well-known for having the components tangle together when collapsed or in the process of being constructed.

Other styles of reclining chairs may include various locking mechanisms, such as spring-loaded pins that engage holes in the chair frame, or locking knobs that screw down to fix moveable elements in place. There may be problems with these types of locking mechanisms. These chairs, being designed to be portable, naturally attempt to minimize weight by using hollow tubing of lightweight materials, such as aluminum, as the frame structure. When holes are made in this material, the structural strength of these members can be compromised. Additionally, the holes in the members may be subject to tearing out, as these lightweight materials generally do not have great sheer strength. Under repeated stress, the locking pins can perhaps be forced out of the holes, causing the frame to be additionally weakened, and perhaps allowing the chair to fall freely to its horizontal position.

Locking knobs which operate by forcing a screw to tighten on a hollow frame member, can also cause the frame member to flatten or even collapse, again causing the back to be suddenly unsupported.

There have been several attempts to make reclining folding chairs. U.S. Pat. No. 2,467,909 to Rechler discloses a folding chair that moves from a upright position to a reclining position. The arm support includes pivotal links which allow the arm and its attached back support members to tilt. The chair as a whole folds into a flat configuration, which may be a bit tedious to expand if the links fall into the wrong orientation while the user attempts to straighten the legs.

U.S. Pat. No. 2,015,335 to Blumenthal shows an adjustable chair, which appears bulky and awkward to assemble.

U.S. Pat. No. 5,882,068 to Levine discloses a folding chair apparatus with a sliding/locking mechanism by which the angular positioning of the back can be varied. However, this locking mechanism has the same disadvantages of wear on the frame members and danger of slippage discussed above.

U.S. Pat. No. 5,082,324 to Harada shows a reclining chair with a complicated locking mechanism where the diameter of an inner tube is changed inside a second tube to act as a position lock. Once again, the opportunity for device wear makes the locking of position somewhat uncertain. The same can be said of U.S. Pat. No. 4,251,107 to Sato, which also discloses a relatively complex cam mechanism which is used as a locking brake.

Thus, there is a need for a portable reclining chair that can securely retain either an upright or reclining position without the need for locking devices, is lightweight enough to be easily portable, and which easily and quickly collapses to a very compact configuration.

DISCLOSURE OF INVENTION

Accordingly, it is an object of the present invention to provide a chair that easily and quickly adjusts from an upright position to a reclining position.

Another object of the invention is to provide a chair that securely remains in either an upright or a reclining position.

And another object of the invention is to provide a chair that remains in either position without a locking mechanism.

Yet another object of the present invention is to provide a chair which expands or collapses quickly.

A further object of the present invention is to provide a chair which expands from or contracts towards a central point or area as a whole, and thus requires minimal assembly.

An additional object is to provide a collapsible reclining chair that has few loose parts that can be misplaced.

Briefly, one preferred embodiment of the present invention is a collapsible reclining chair, having a frame assembly which includes a number of angled frame members, the upper ends of the angled frame members being pivotally attached to upper connectors, and the lower ends being pivotally attached to feet. The frame assembly as a whole expands outwardly from a central area. The frame assembly also includes upright members, and a support surface, having a back portion. The lower ends of each of the upright members are attached to one of the angled members by a reversible joint, so that the reclining chair is movable from an upright position when the reversible joints are in a first position, to a reclining position when the reversible joints have been reversed to a second position.

In a first embodiment, the reversible joint includes a pivot housing having first and second pivots. The lower end of one of the upright members is pivotally attached to the first pivot of the pivot housing, the second pivot of the pivot housing is pivotally attached to one of the angled frame members.

In a second embodiment, the reversible joints include an extension member having first and second ends and a sleeve housing attached to one of the angled members, and having a sleeve pivot, and a pivot housing having first and second pivots. The lower end of one of the upright members is pivotally attached to the first pivot of the pivot housing, the first end of the extension member is pivotally attached to the second pivot of the pivot housing, and the second end of the extension member is pivotally attached to the sleeve pivot of the sleeve housing.

A third embodiment has a modified reversible joint and no footrest.

An advantage of the present invention is that completion of movement from an upright to reclining position, or vice-versa, is aided by gravity.

Another advantage of the invention is that retention of the chair in either upright or reclined position is aided by gravity.

And another advantage of the invention is that no external locking mechanism is required to maintain the chair in position, and when loaded by the weight of an occupant, retention of the position is aided.

A further advantage of the invention is that it is simple to manufacture, and collapses to a compact shape for shipping or storage.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
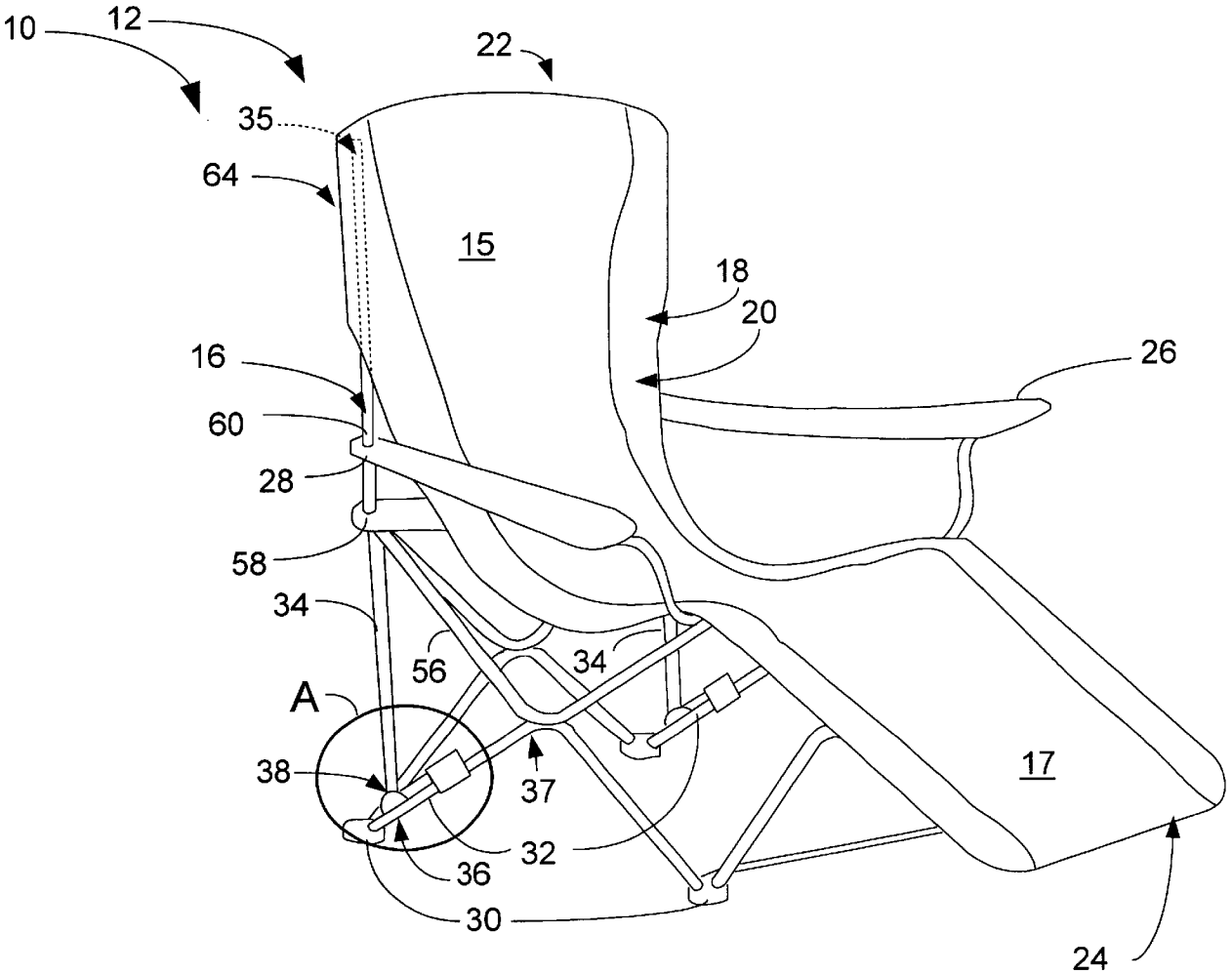
FIG. 1 illustrates a front perspective view of the reclining chair of the present invention in upright position.

A preferred embodiment of the present invention is a reclining chair having a reversible joint or pivot mechanism by which the chair can be converted from an upright position to a reclining position. As illustrated in the various drawings herein, and particularly in the view of FIG. 1, a form of this preferred embodiment of the inventive device is depicted by the general reference character 10.

Figure 3:
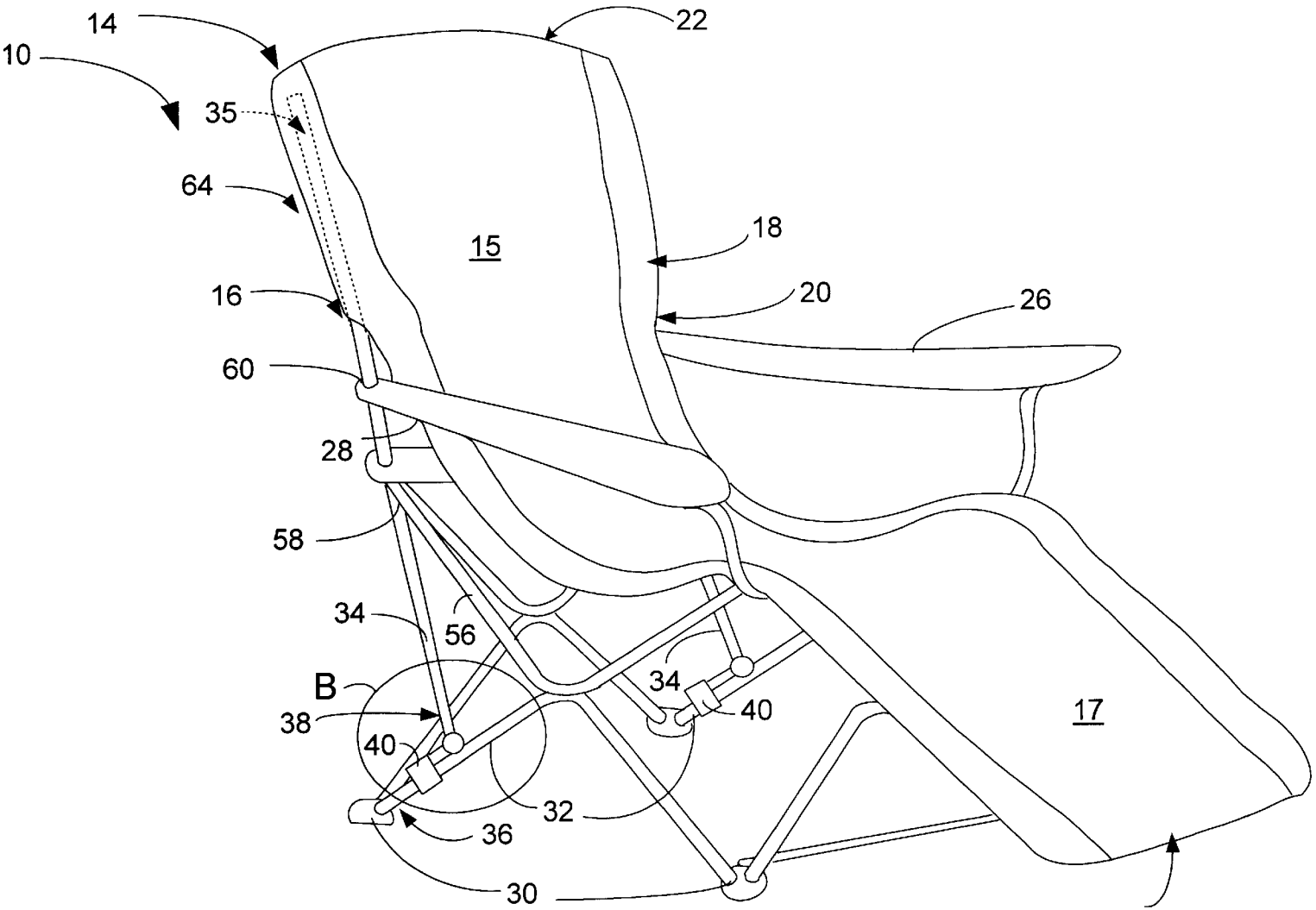
FIG. 3 illustrates a front perspective view of the reclining chair of the present invention in reclining position.

FIG. 1 illustrates a portable reclining chair 10 which is in upright position 12. The reclining position 14 is shown in FIG. 3. Referring to both of these figures, there is generally a frame assembly 16, which is covered by a support surface 18 having a material covering 20. For purposes of orientation, the chair will be considered to have a head end 22 and a foot end 24 and a right arm 26 and a left arm 28. The chair will be considered to have generally a back portion 15, and preferably a foot rest 17, although this is not a necessity, and variations may exist which recline without the presence of a foot rest, and also without arm rests. The chair 10 also includes four feet 30, two angled members 32 and two upright members 34. The angled members 32 will be considered to have lower 36, and an upper end 37, and the upright member 34 will be considered to have a head end 35 and a foot end 38.

Figure 2:
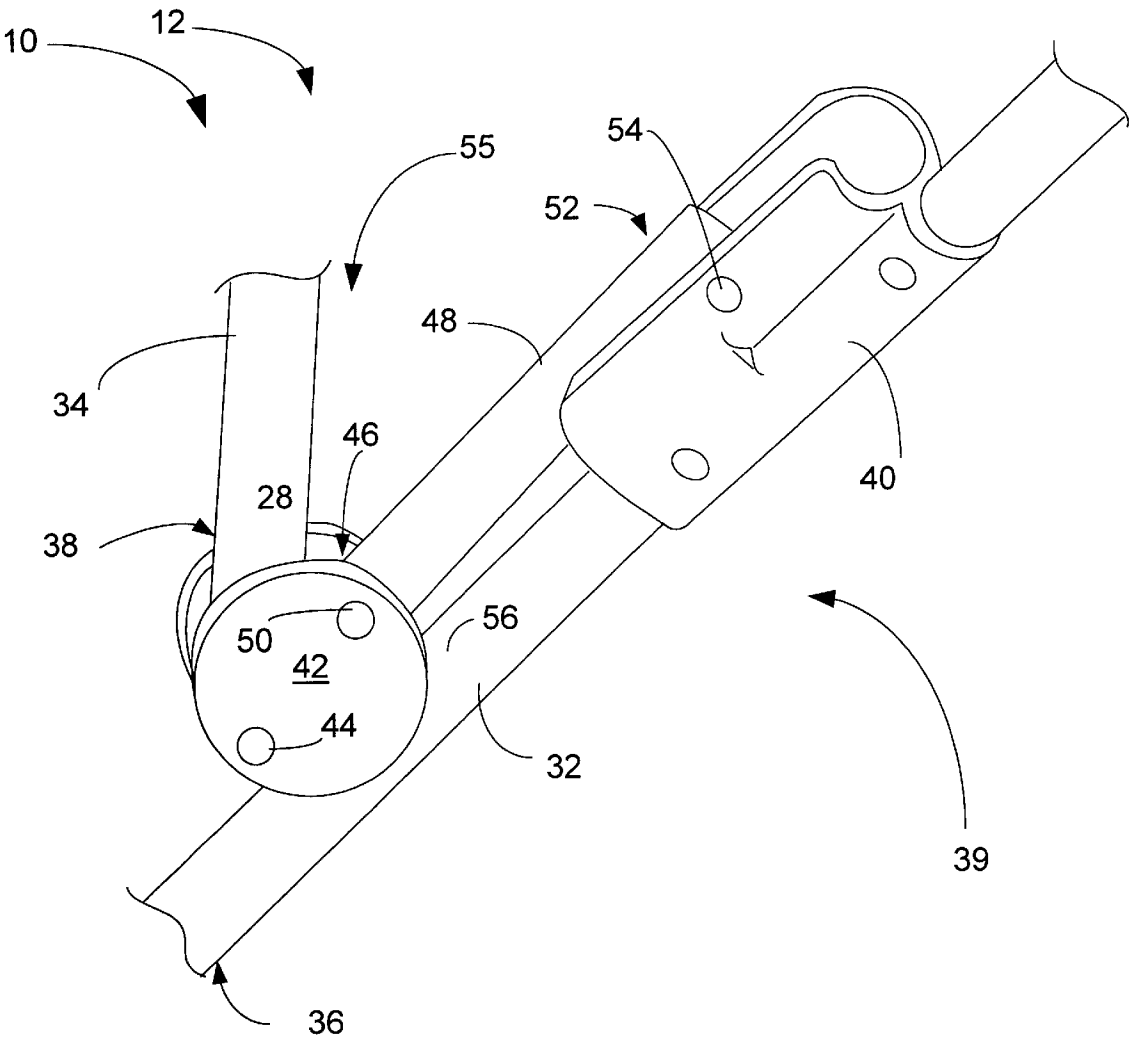
FIG. 2 shows a detail view of the pivot mechanism shown in circle A of FIG. 1.

The area within circle A in FIG. 1 is shown in detail in FIG. 2. Generally, the parts contained within this view, which enable the chair 10 to reposition from an upright position 12 to a reclining position 14, will be referred to as a reversible joint 39. A double-barreled sleeve housing 40 is shown positioned on angled member 32. A pivot housing 42 is shown to be connected to the lower end 38 of upright member 34 at a first pivot 44, and is connected to the first or outer end 46 of an extension member 48 at a second pivot 50. The second or inner end 52 of the extension member 48 is connected to the sleeve housing 40 at a sleeve pivot 54. In this description, "inner" and "outer" can be thought of as relative to a pair of radial arms 55, one at each side, originating at the sleeve pivots 54. Each of these radial arms 55 thus includes an extension member 48, a pivot housing 42 and an upright member 34.

Returning to FIG. 1, the upright member 34 has attachment points for joining to an upper angled member 56, and one of the arms (in the figure, left arm 28 is most easily seen) at lower pivot 58, and upper pivot 60, respectively.

Figure 4:
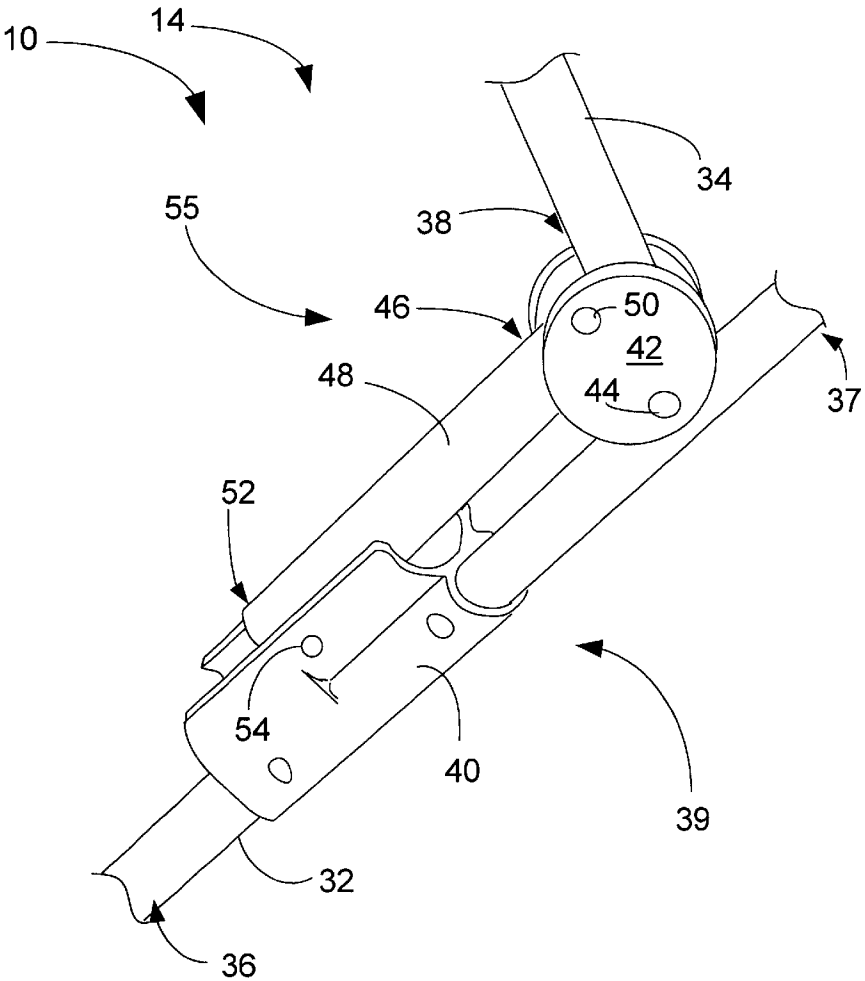
FIG. 4 shows a detail view of the pivot mechanism shown in circle B of FIG. 3.

FIGS. 3 and 4 show the chair 10 in reclining position 14, with FIG. 4 being a close up detail of circle B in FIG. 3. Once again, the sleeve housing 40 is shown on the angled member 32. The extension member 48 is again shown connected at the inner end 52 to the sleeve pivot 54 and to the pivot housing 42 at the second pivot 50. The upright member 34 is attached to the pivot housing 42 at first pivot 44.

Figure 5B:
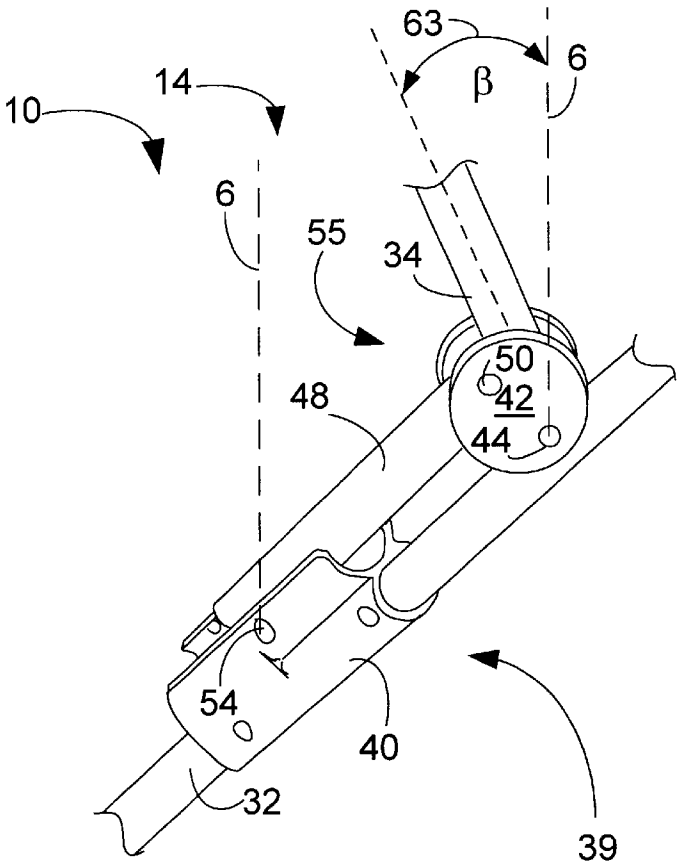
FIGS. 5A and B show details views of the pivot mechanism of the present invention moving from upright to reclined position.
Figure 5A:
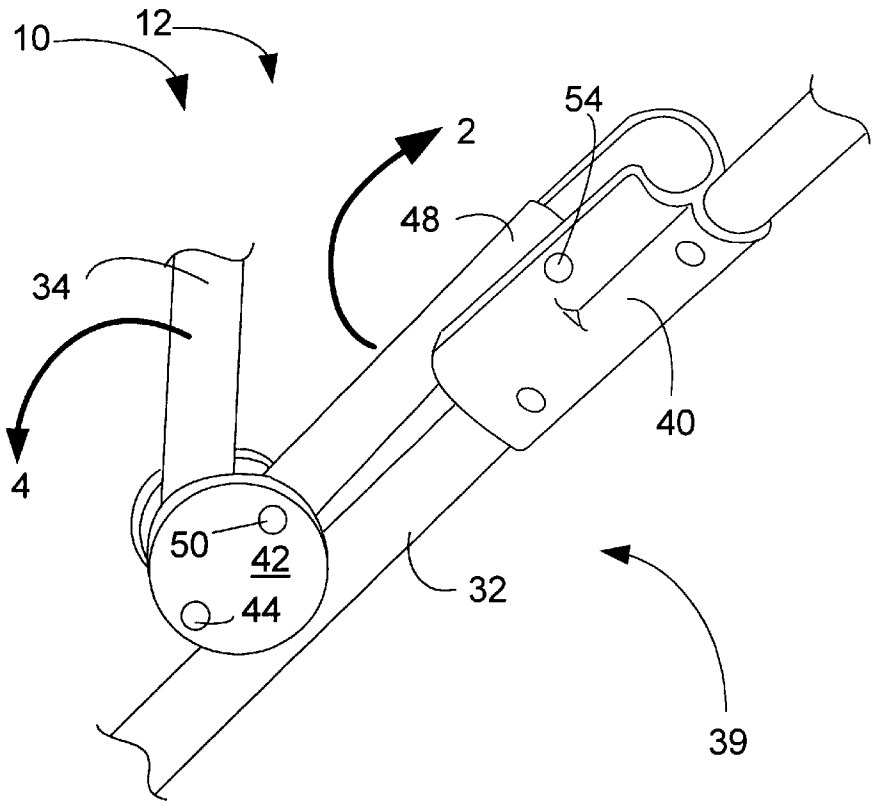

FIGS. 5A and B repeat FIGS. 2 and 4, with the addition of direction arrows clockwise 2 and counterclockwise 4. As shown, when the chair 10 is moved from upright position 12 to reclining position 14, extension member 48 is pivoted in a clockwise direction about sleeve pivot 54 approximately 180 degrees until the pivot housing 42 contacts the angled member 32. It is to be understood that 180-degree rotation is not required, and that there may be a mechanical stop in the sleeve housing 40 or other device, which may be used to limit or extend rotation to any other appropriate position. As the extension member 48 is rotated clockwise 2, the upright member 34 also rotates counterclockwise 4 about the first pivot 44 in the pivot housing 42. The pivot housing 42 is thus rotated to a position higher from the ground on the angled member 32, but the upright member 34 is now tilted at an angle $\alpha$ 62 measured counterclockwise from vertical reference line 6. This angular tilt allows the upper portion 64 (see FIGS. 1 and 3) of the chair 10 to recline in an angle roughly corresponding to angle $\beta$ 63. When this angle is assumed, the arms 26, 28 pivot slightly at upper pivot 60 so that they remain roughly horizontal. The upper angled members 56 also pivot slightly at the lower pivots 58. Additionally, there may be pivots (not shown) in the feet 30 which allow the attached members to adjust to the reclining angle.

The sleeve housing 40 shown is preferably fixed in position on the angled member 32 by crimps, bolts or other attachment devices. It is possible however that the sleeve housing 40 may be slideably attached to the angled member 32, and may travel up and down to provide a range of reclining angles. There may be a locking device such as a clamp that could be engaged to fix the sleeve housing 40 in the desired position, and later released for further adjustment.

One feature of the reclining chair 10 which is especially advantageous is its ease of assembly and its ability to remain in either position without a locking mechanism. In this regard, the design relies on gravity to maintain position. Looking at FIG. 5A, the weight of the chair and occupant is supported in a nearly vertical force vector in the upright member 34. Assuming that the occupant is removed, the weight of the upper portion 64 of the chair will still tend to maintain the upright position until clockwise rotation 2 is applied to the radial arm 55. Once it passes the vertical 6, however, it will tend to fall to the extreme of clockwise rotation 2, until pivot housing 42 contacts angled member 32 or is otherwise mechanically stopped. The weight of the chair 10 will then tend to urge the upright member 34 to the extreme of the counterclockwise rotation 4, and thus remain in the reclining position 14. Thus no "locking mechanism" as such is required to keep the chair 10 in position, although it is obvious that such a mechanism could be added.

Figures 6A, 6B, 6C:
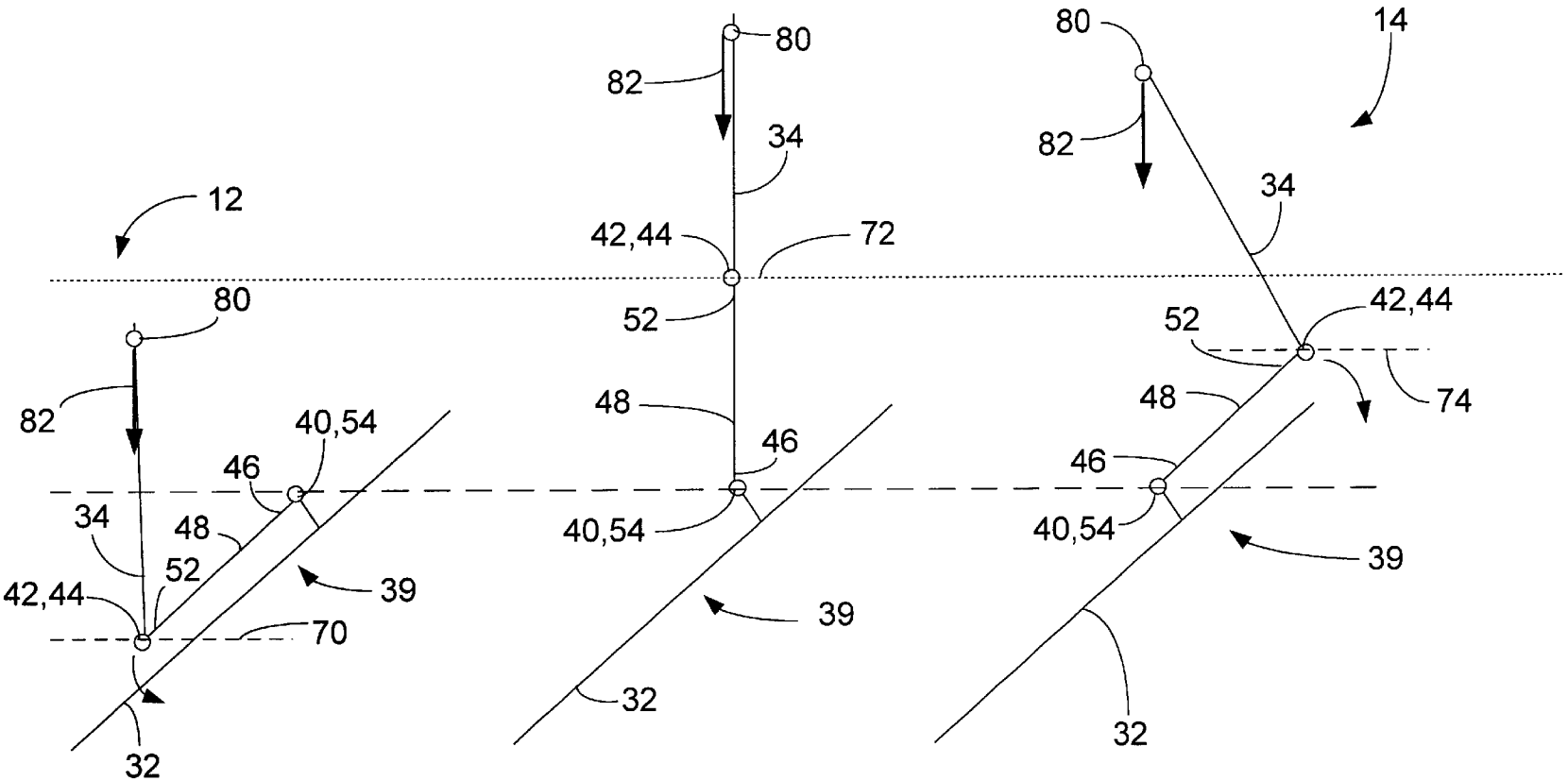
FIGS. 6A–C shows simplified diagrams of the members and forces involved in the reversible joint when the chair is moved from a first, upright position in FIG. 6A to a reclining position in FIG. 6B.

FIGS. 6A–C shows simplified diagrams of the members and forces involved in the reversible joint 39 when the chair 10 is moved from a first, upright position 12 to a reclining position 14. The bottom line in each diagram models one of the angled members 32. Each reversible joint 39 includes an extension member 48 which is pivotally attached to a sleeve housing 40 at a first end and pivotally attached to a pivot housing 42 at a second end 52, the pivot housing 42 being also pivotally attached to one of the upright members 34. Each of the sleeve housings 40 is also attached to one of the angled members 32.

Each of the reversible joints 39 is moveable from a first position 12 (FIG. 6A) to a second position 14 (FIG. 6C), and in moving from the first position 12 to the second position 14, the pivot housing 42 moves from a first vertical minimum 70 at the first position 12 through a vertical maximum 72 to a second relative vertical minimum 74 at the second position 14. The center of gravity of the upper chair portion 80 is shown in all three figures, with an arrow 82 indicating its line of action. Once rotation of the reversible joints 39 has moved the upper portion center of gravity 80 so that it is on either side of the vertical maximum 72, the weight of the chair maintains the chair 10 in one of the relative vertical minimums 70, 72 at first and second positions 12, 14. As shown by the direction arrows 82, the pivot housing 42 is urged by the action of the weight to remain in the direction of relative vertical minimums 70, 72, except that the members have reached a mechanical stop at this point, and can travel no further in the directions indicated. Thus no locking mechanism as such is necessary to keep the chair in either position, since its weight (and the weight of the user, when added), tends to keep the chair safely in either upright or reclining position 12, 14.

Figure 7:
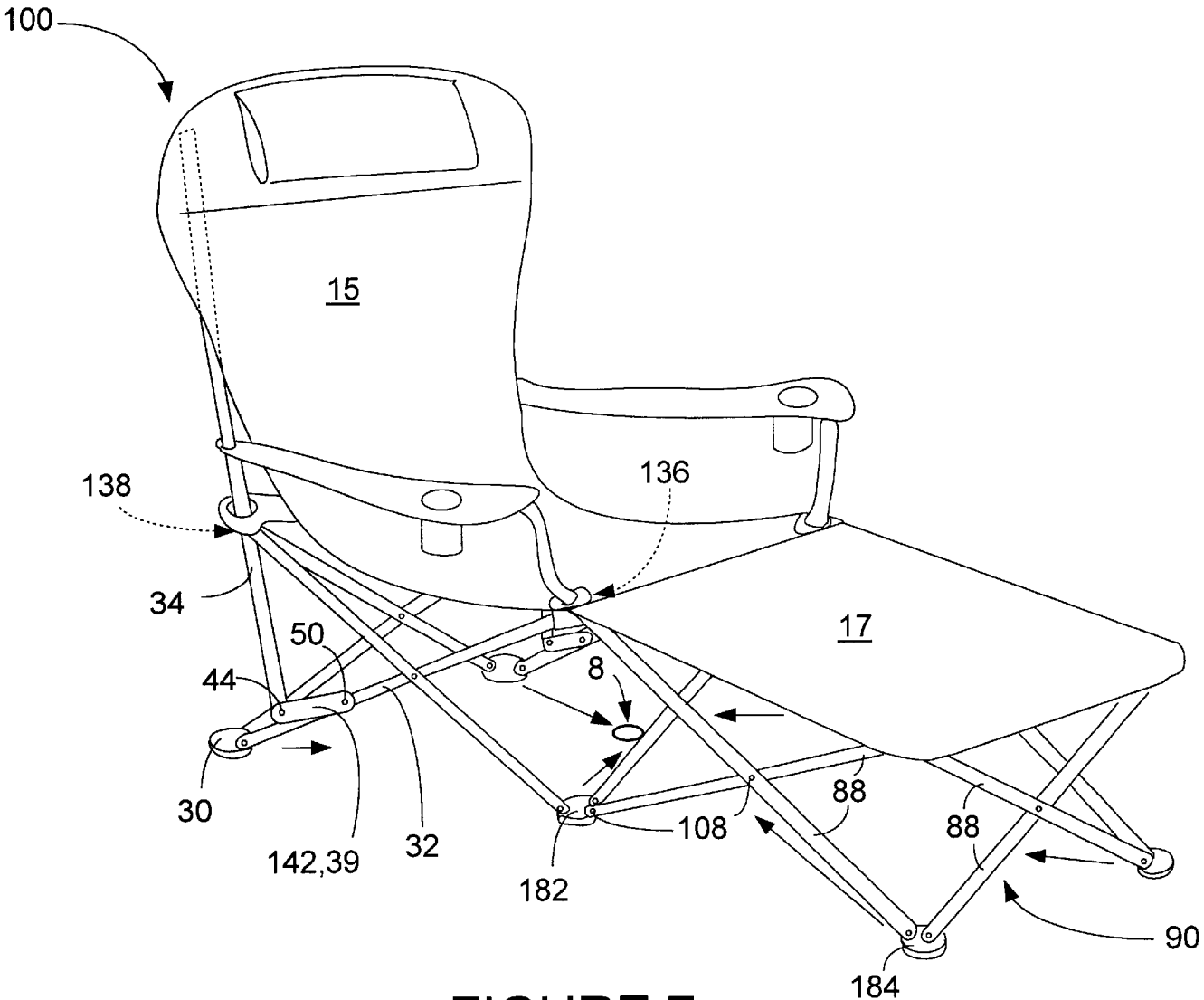
FIG. 7 illustrates a collapsible reclining chair.

FIG. 7 shows a second embodiment of the reclining chair, which is collapsible. This collapsible reclining chair shall be referred to by element number 100, and where elements similar to those in the earlier embodiment are used, they shall be referred to by the same element numbers.

The collapsible reclining chair 100 again generally includes a back portion 15, which is supported by upright members 34. These upright members 34 are again attached to angled members 32 by reversible joints 39, which operate much as described before. The reversible joints 39 in this embodiment are slightly different, as the sleeve housing, pivot housing, and extension member on each side have been replaced by a unitary pivot housing 142, which includes a first pivot 44 and a second pivot 50. The first pivot 44 pivotally attaches the upright member 34 to the pivot housing 42, and the second pivot 50 pivotally attaches pivot housing 42 to the angled member 32, only directly, instead of through an extension member. The action when moving from an upright position to a reclining position is much the same, as the first pivot 44 passes through a vertical maximum 72 to reach vertical minimums 70, 74 at either the upright position 12 or the reclining position 14 (see FIG. 6A–C).

Figure 8:
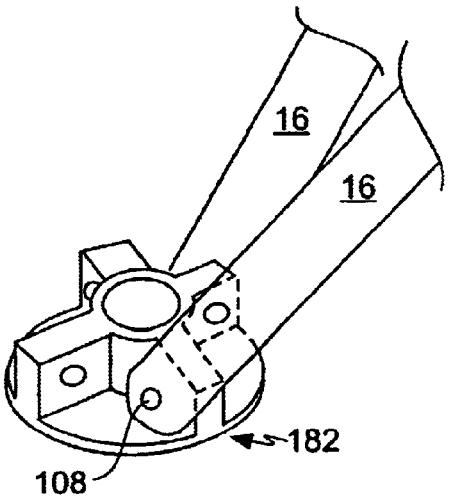
FIG. 8 shows a four-pivot foot used in a collapsible reclining chair.
Figure 9:
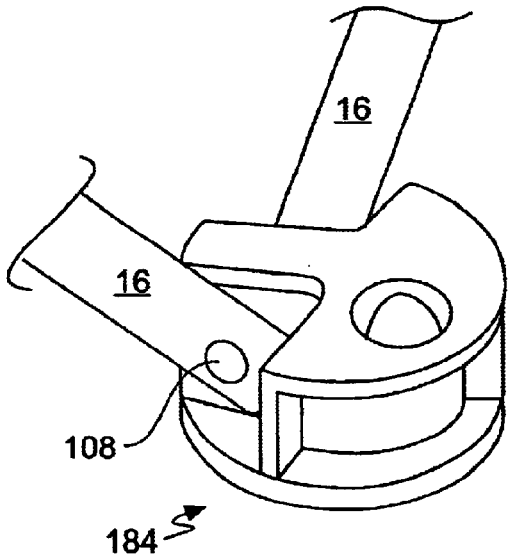
FIG. 9 shows a two-pivot foot used in a collapsible reclining chair.
Figure 10:
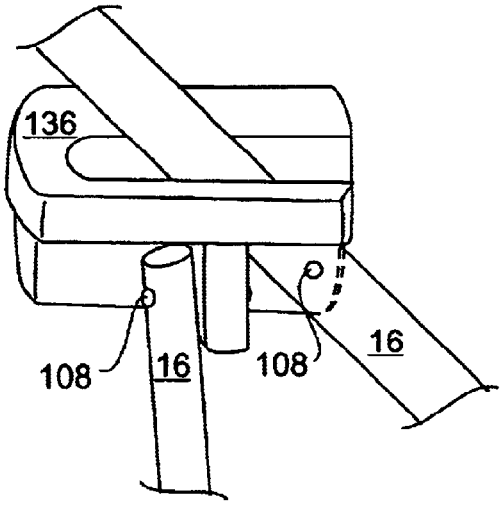
FIG. 10 shows an upper pivot assembly used in a collapsible reclining chair.
Figure 11:
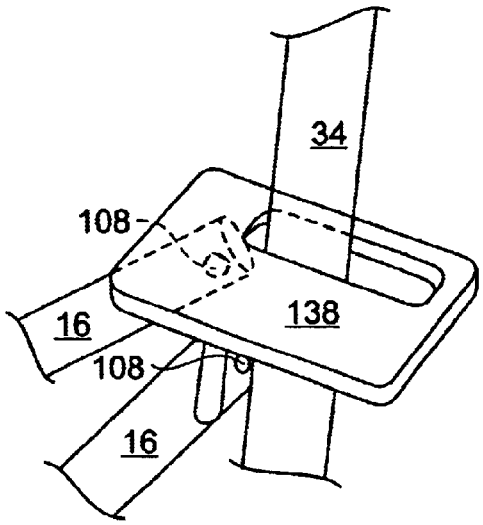
FIG. 11 shows a rear pivot assembly used in a collapsible reclining chair.
Figure 12:
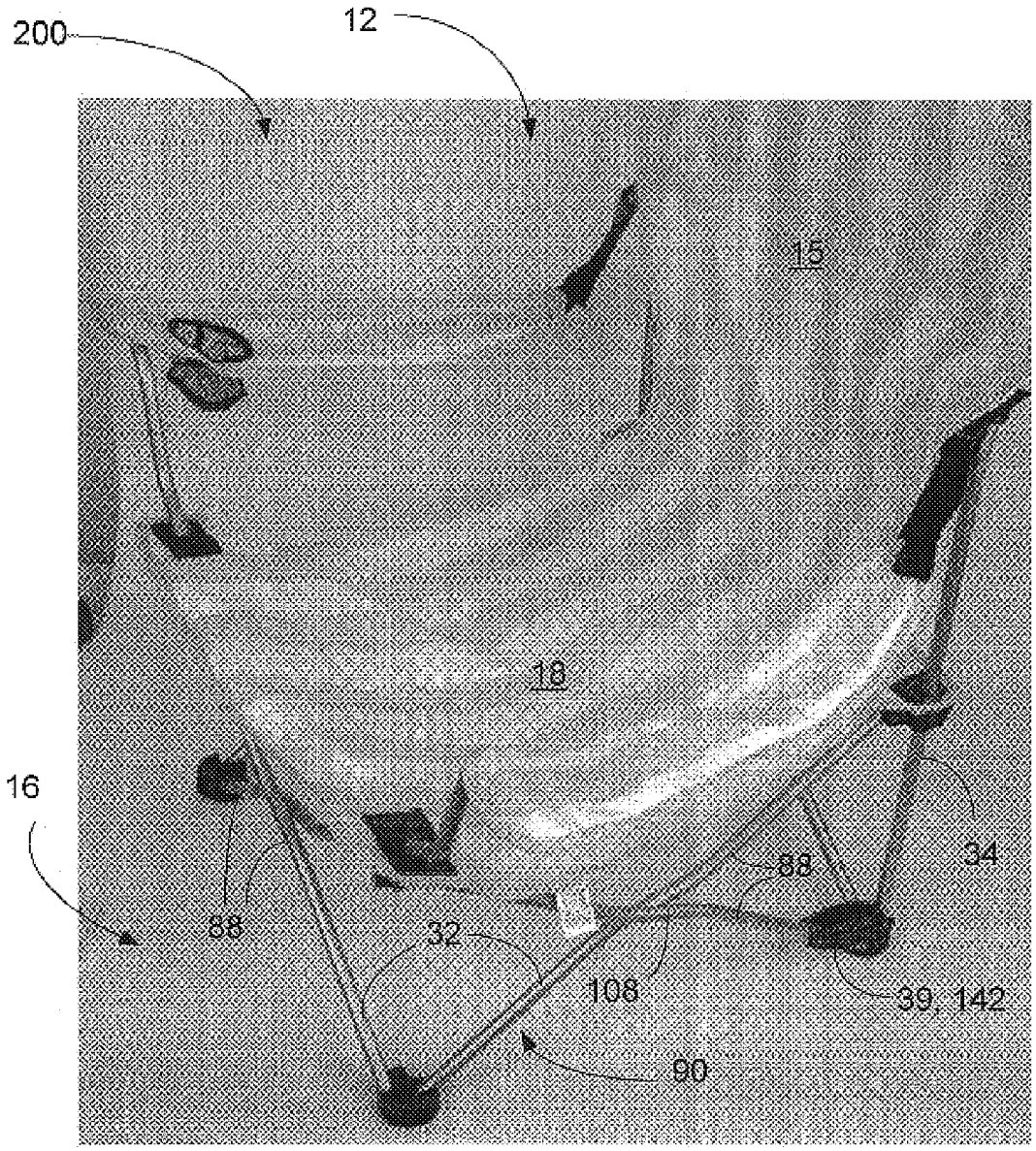
FIG. 12 illustrates a third embodiment of collapsible reclining chair, without foot-rest, which is in upright position, seen in a perspective view.
Figure 13:
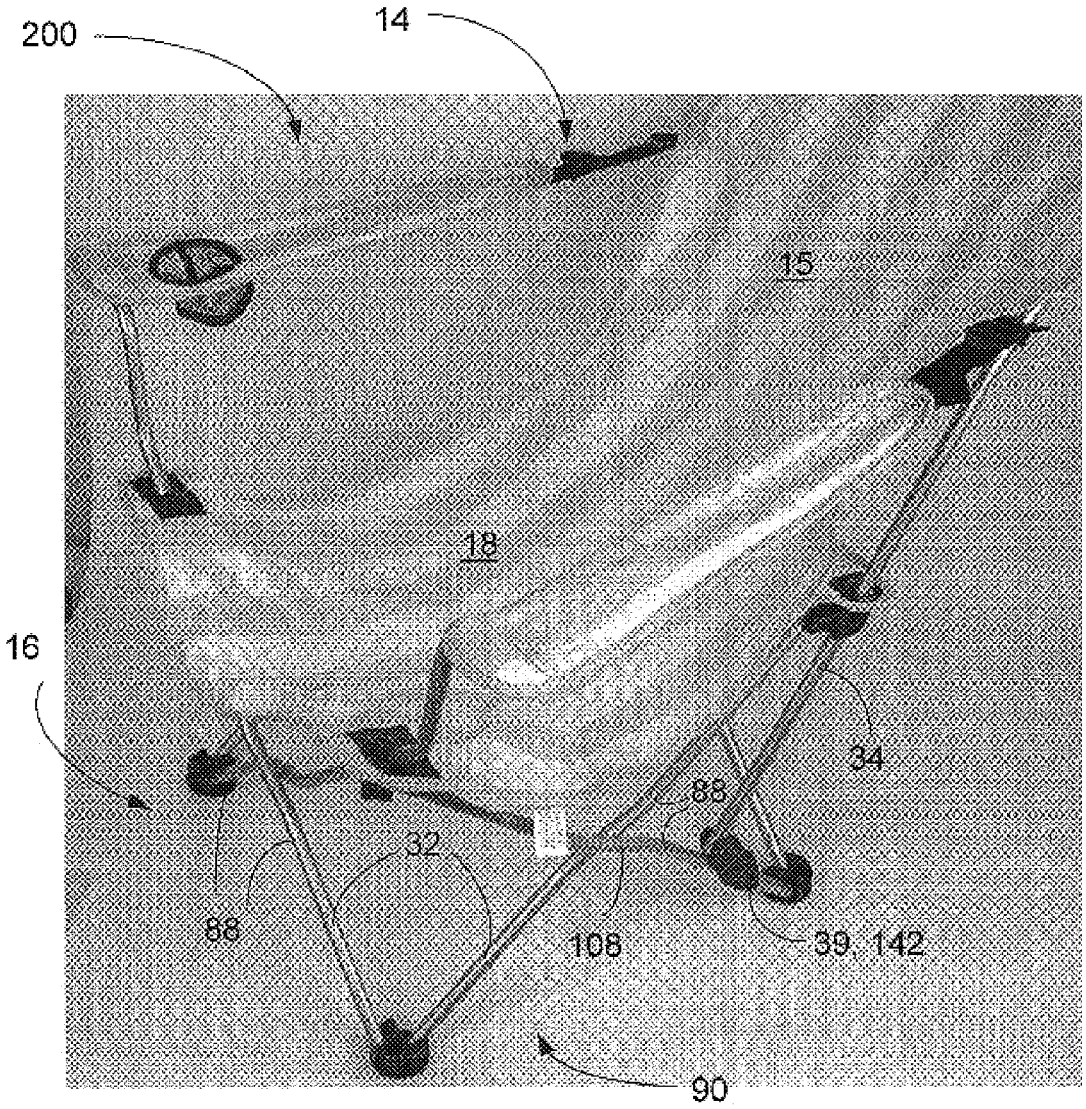
FIG. 13 illustrates a third embodiment of collapsible reclining chair, without foot-rest, which is in reclining position, seen in a perspective view.

To make the chair collapsible, the frame assembly members 16 are arranged in a series of "X" patterns or scissor-pairs with hinges or pivots 108 at the intersection of the members 16. Also included are upper pivot assemblies 136 (see FIG. 10), rear pivot assemblies 138 (see FIG. 11), four pivot feet 182 (see FIG. 8), and two pivot feet 184 (see FIG. 9), which allows the frame 16 to collapse towards a central area 8 when it is to be stored, or collapsed for easy transport.

FIGS. 12–19 illustrate a third embodiment of reclining chair 200 which also collapses toward a central area 8, but which includes a slightly different reversible joint mechanism 39 and includes no footrest. FIGS. 12, 14, 16 and 18 show the chair 200 or portions thereof in upright position 12. The reclining position 14 is shown in FIGS. 13, 15, 17 and 19.

Referring generally to FIGS. 12–19, there is again generally a frame assembly 16, which is covered by a fabric covering 18. The frame 16 includes angled members 32 and upright members 34. These upright members 34 are again attached to angled members 32 by reversible joints 39, and which again use a unitary pivot housing 142, which includes a first pivot 44 and a second pivot 50. The first pivot 44 pivotally attaches the upright member 34 to the pivot housing 42, and the second pivot 50 pivotally attaches pivot housing 42 to the angled member 32. The action when moving from an upright position to a reclining position is much the same, as the first pivot 44 passes through a vertical maximum 72 to reach vertical minimums 70, 74 at either the upright position 12 or the reclining position 14 (see FIG. 6A–C).

When in upright position 12, the reversible joints 39 are positioned as shown in FIGS. 12, 14, 16 and 18. The back support portion 15 thus makes a smaller angle $\alpha$ 62.

FIGS. 13, 15, 17 and 19 show the chair 200 and frame 16 in the reclining position 14. The reclining pivot assemblies are positioned as shown, and a much larger angle $\beta$ 63. Slots 86 in the rear upper pivot assembly 138 allow the upright members 34 freedom to change angle, as well as allowing them to slip vertically when the frame 16 is to be folded.

One feature of the reclining chairs 10, 100, 200 which is especially advantageous is its ease of assembly and its ability to remain in either position without a locking mechanism. In this regard, the design relies on gravity to maintain position. The weight of the chair and occupant is supported in a nearly vertical force vector in the upright member 34. Assuming that the occupant is removed, the weight of the upper portion of the chair will still tend to maintain the upright position. Thus no "locking mechanism" as such is required to keep the chair 10, 100, 200 in position, although it is obvious that such a mechanism could be added.

In reference to both embodiments 100, 200, seen in FIGS. 7–19, the pivot assemblies 136, 138 and pivots 108 connect all the angled frame members 32 to each other, so there are no loose pieces to be gathered and assembled. The frame 16 can be thought of as an extended scissors-frame assembly 90 since the tops and bottoms of each pair of frame members scissor together or apart. These scissor pairs 88 are then joined in an extended scissor assembly 90 where the ends of multiple pairs are joined at the pivot assemblies 46. They also allow the frame assembly 16 as a whole to be collapsed or expanded in a very easy and efficient manner. Force directed at any one of the corners causes movement in all the other corners, so that there is movement of the whole frame assembly 16 in either an inward or outward direction, relative to the central area 8. The pivots 108 allow the frame assembly 16 to move towards a central area 8 from all sides as a unit when the frame 16 is to be collapsed, and to move away from this central area 8 when expanding.

This configuration will be spoken of as "expanding outwardly from a central area", although it is to be understood that one of the feet may actually remain in fixed position, while the remainder of the feet move outward. In other words, the central reference area from which the feet move, may itself move laterally. One example of this occurs when the collapsed support frame is placed in the corner of a yard, where, say, the left rear foot of the frame is in the left rear corner of the yard, and thus is constrained from movement in a further leftward or rearward direction. When the frame expands, all the other, non-constrained feet will expand outwardly from a central area to the right, or forward, or both, even as the central area itself will move to the right and forward, relative to the immobile left rear foot.

Figure 14:
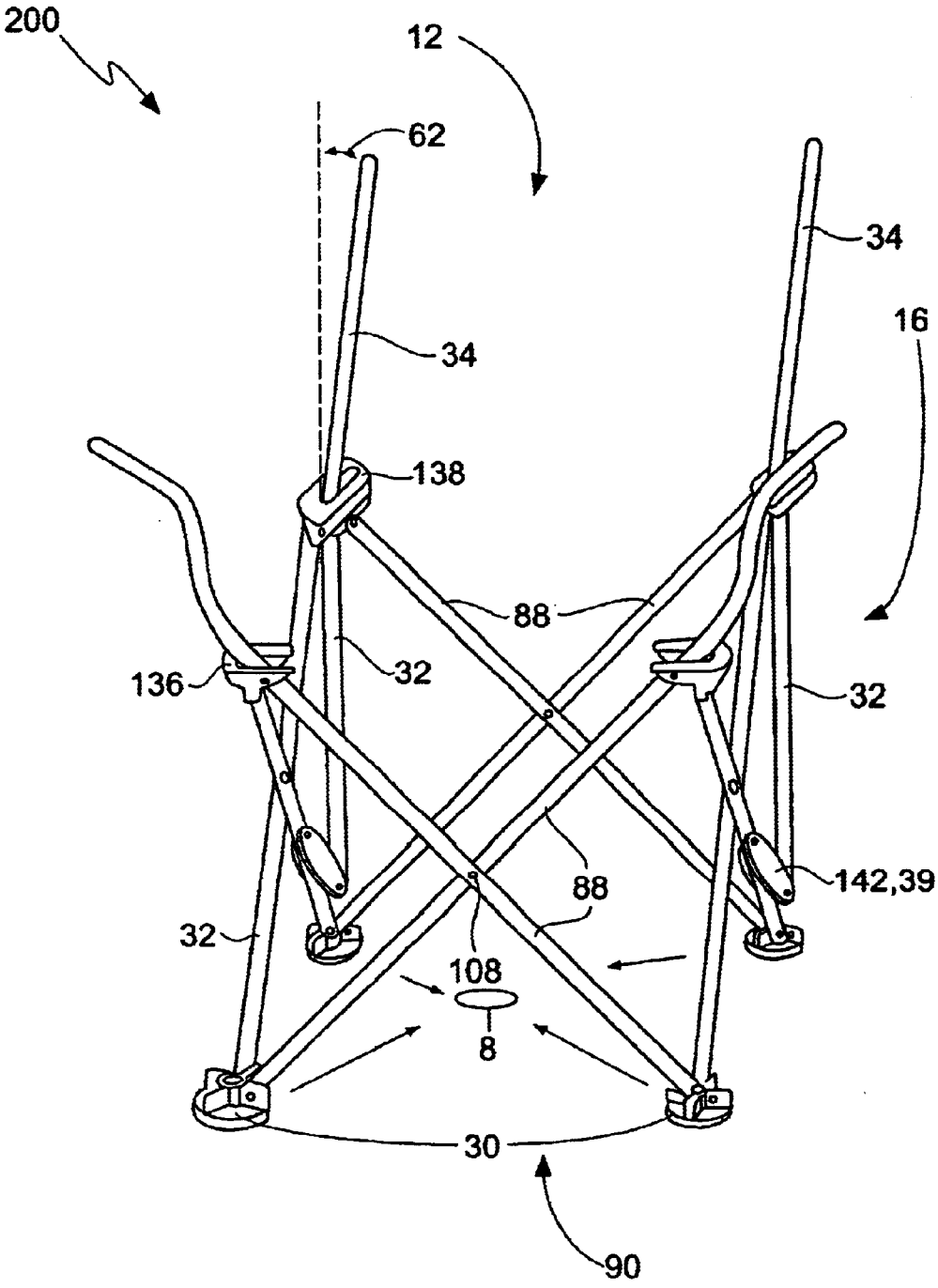
FIG. 14 shows the frame of a third embodiment of collapsible reclining chair, without foot-rest, which is in upright position, seen in a perspective view.
Figure 15:
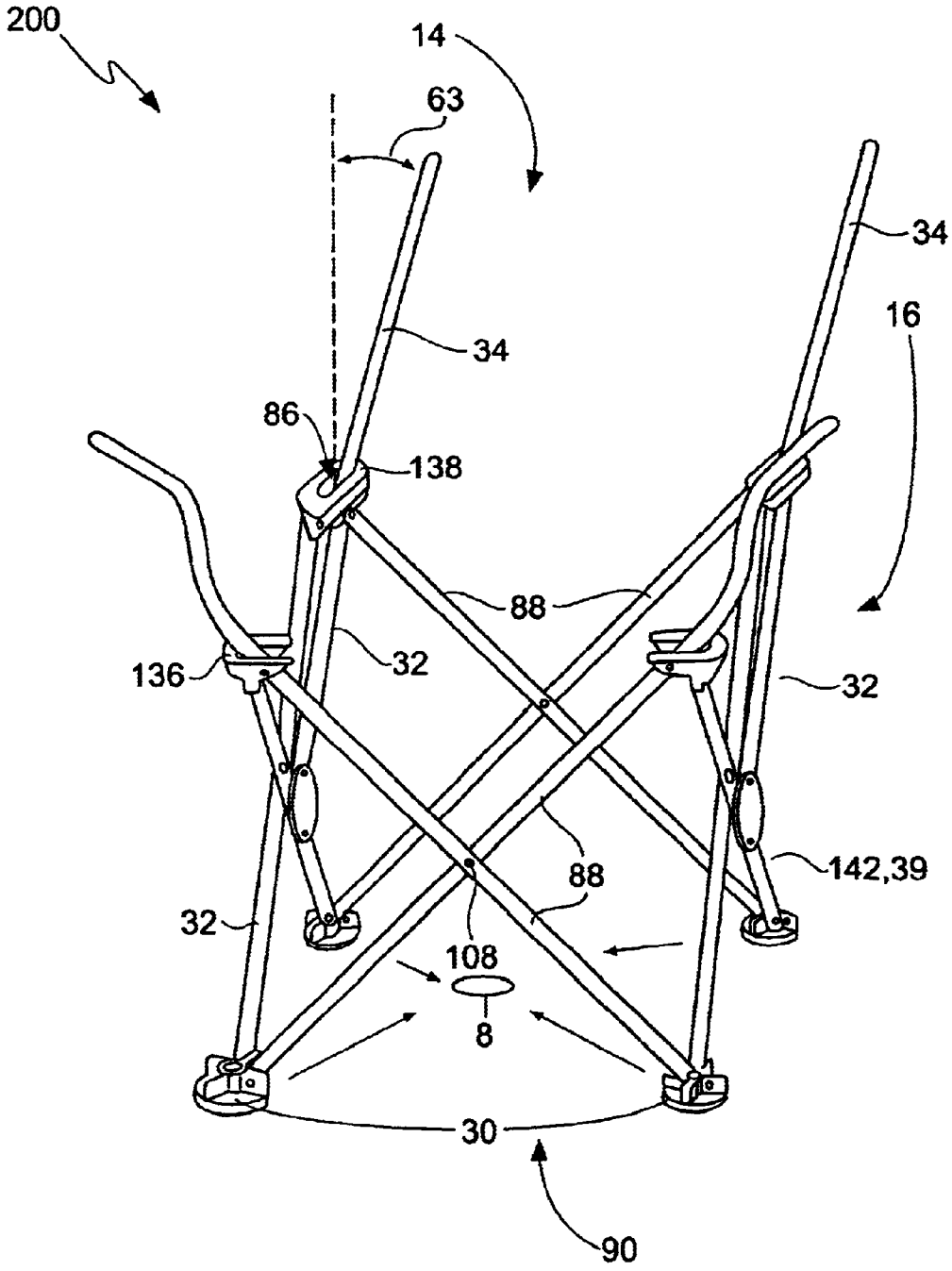
FIG. 15 illustrates the frame of a collapsible reclining chair, without footrest, which is in reclining position, seen in a perspective view.
Figure 16:
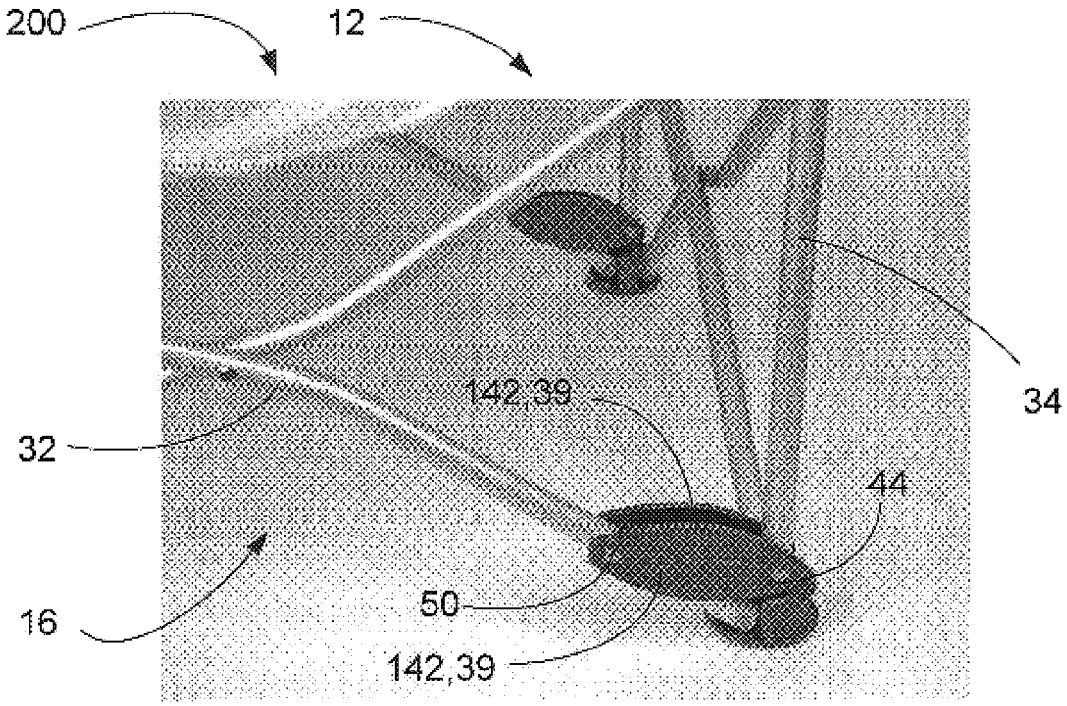
FIG. 16 illustrates the reversible joint mechanism of a collapsible reclining chair, which is in upright position.
Figure 17:
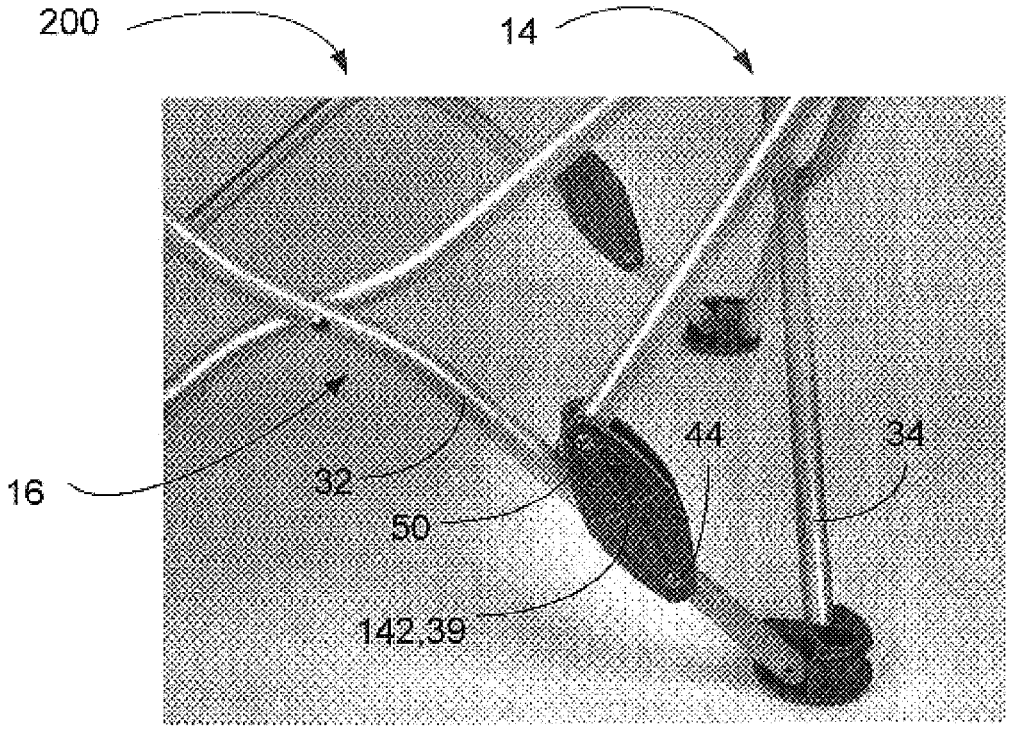
FIG. 17 illustrates the reversible joint mechanism of a collapsible reclining chair, which is in reclining position.
Figure 19:
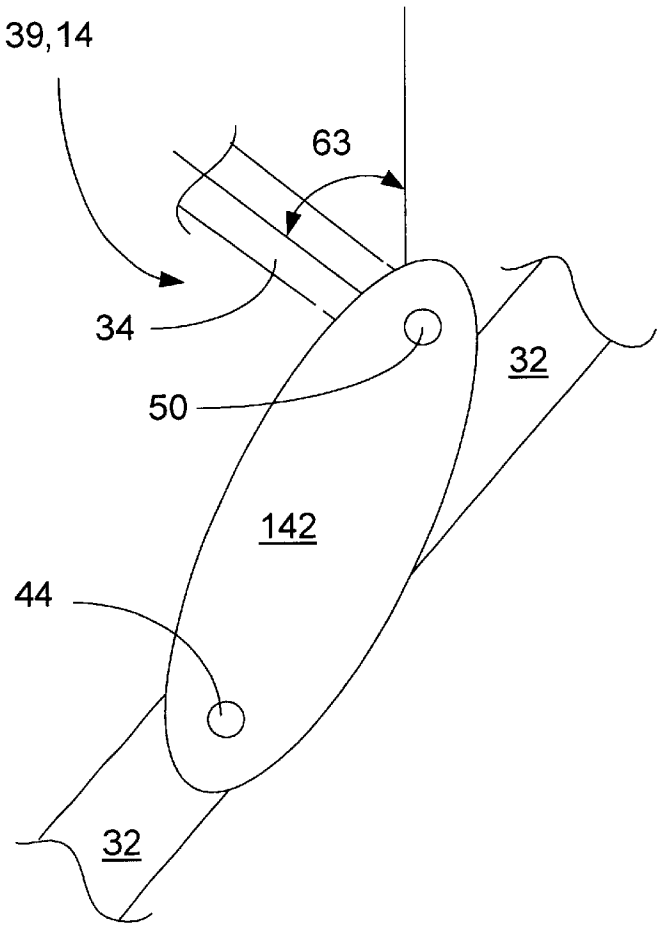
FIG. 19 illustrates the reversible joint mechanism of a collapsible reclining chair, which is in reclining position.
Figure 18:
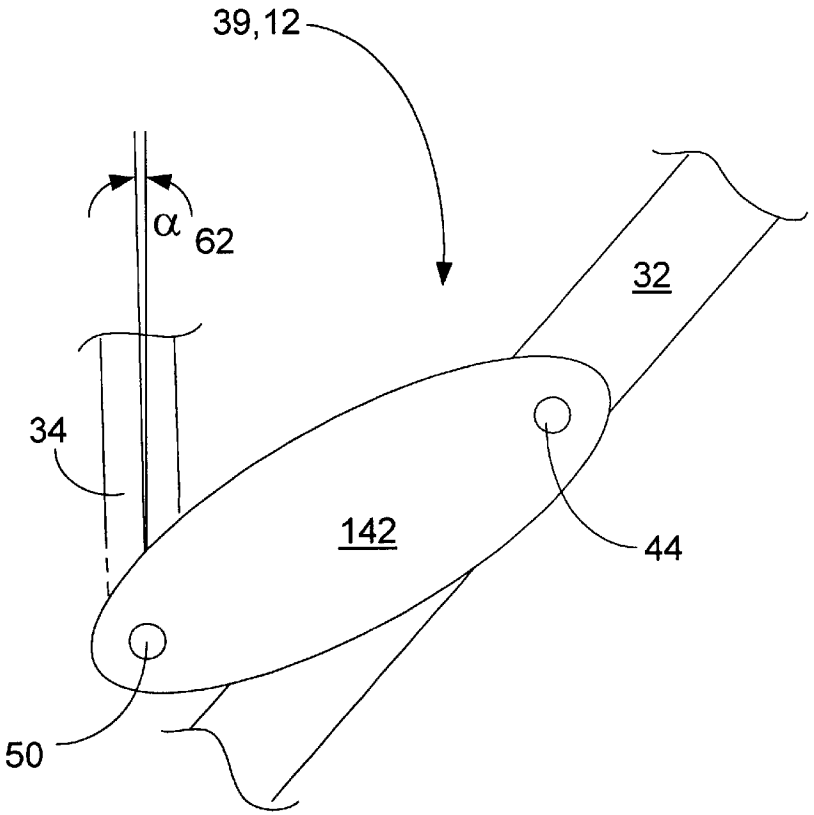
FIG. 18 illustrates the reversible joint mechanism of a collapsible reclining chair, which is in upright position.

It should also be understood that all the lines of direction of the movement of the feet are not expected to intersect at a precise point. The central area 8 is thus a relatively small region from which the feet 30 move outwardly, but there should be no inference that all feet must move in a specific lines, such as radially from a single specific center point. To one skilled in the art, it will be apparent that if such precise directionality were attempted, manufacturing errors would inevitably introduce variations. Thus, the expansion is considered to move outwardly from a central area or region, and should not be construed to imply any particular lines of direction, other than generally outward from this central area. The direction arrows and central area 8 shown in FIGS. 7 and 14, are therefore not provided to show specific lines of movement which must be followed, but merely a general direction of movement towards, or away from, a general central area 8.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

Industrial Applicability

The present collapsible reclining chair 10, 100, 200 is well suited for application in the home, backyard, or on camping trips and picnics.

When the chair 10, 100, 200 is to be used, it is set up so that it rests in either the upright position 12 or the reclining position 14. The collapsible reclining chair 10, 100, 200, has a frame assembly 16 which includes angled frame members 32, the upper ends 37 of the angled frame members 32 being pivotally attached to upper connectors 136,138, and the lower ends 36 being pivotally attached to feet 30. The frame assembly 16 also includes upright members 34 and as a whole expands outwardly from a central area 8.

Each of the reversible joints 39 is moveable from a first position 12 to a second position 14, and in moving from the first position 12 to the second position 14, the pivot housing 42 moves from a first vertical minimum 70 at the first position 12 through a vertical maximum 72 to a second relative vertical minimum 74 at the second position 14. The center of gravity of the upper chair portion 80 is shown in all three figures, with an arrow 82 indicating its line of action. Once rotation of the reversible joints 39 has moved the upper portion center of gravity 80 so that it is on either side of the vertical maximum 72, the weight of the chair maintains the chair 10, 100, 200 in one of the relative vertical minimums 70, 72 at first and second positions 12, 14. As shown by the direction arrows 84, the pivot housing 42 is urged by the action of the weight to remain in the direction of relative vertical minimums 70, 72, except that the members have reached a mechanical stop at this point, and can travel no further in the directions indicated.

The chair 10, 100, 200 is thus very simple to assemble, to use and to move from one position to another, and requires no locking mechanism since its weight (and the weight of the user, when added), tends to keep the chair safely in either upright or reclining position 12, 14. The absence of locking mechanisms means that there are fewer moving parts to wear out, and thus the reliability and useful life of the chair 10, 100, 200 is enhanced. The collapsible chair 10, 100, 200 is thus very convenient for use in camping and is easily stored.

For the above, and other, reasons, it is expected that the portable reclining chair 10, 100, 200 of the present invention will have widespread industrial applicability. Therefore, it is expected that the commercial utility of the present invention will be extensive and long lasting.

What is claimed is:

1. A collapsible reclining chair, comprising:

a frame assembly including a plurality of angled frame members, said angled frame members having upper ends and lower ends, the upper ends of said angled frame members being pivotally attached to upper connectors, and the lower ends being pivotally attached to feet, such that said frame assembly as a whole expands outwardly from a central area;

said frame assembly further including upright members, each of said upright members having a lower end;

a support surface, having a back portion, said back portion being held in position by said upright members; and said lower ends of each of said upright members being attached to one of said angled members by a reversible joint, so that said reclining chair is movable from an upright position when said reversible joints are in a first position, to a reclining position when said reversible joints have been reversed to a second position, wherein each of said reversible joints include a pivot housing having first and second pivots, and said lower end of one of said upright members being pivotally attached to said first pivot of said pivot housing, said second pivot of said pivot housing being pivotally attached to one of said angled frame members.

2. The collapsible reclining chair of claim 1, wherein each of said reversible joints comprise:

an extension member having first and second ends;

a sleeve housing having a sleeve pivot, said sleeve housing being attached to one of said angled members;

a pivot housing having first and second pivots; and said lower end of one of said upright members being pivotally attached to said first pivot of said pivot housing, said first end of said extension member being pivotally attached to said second pivot of said pivot housing, said second end of said extension member being pivotally attached to said sleeve pivot of said sleeve housing.

3. The collapsible reclining chair of claim 1, further comprising a footrest.

4. The collapsible reclining chair of claim 1, further comprising armrests.

5. The collapsible reclining chair of claim 4, wherein:

said armrests are pivotally attached to said upright members and which pivot when said chair is moved from said upright position to said reclining position so that they remain roughly horizontal.

6. The collapsible reclining chair of claim 1, further comprising:

upper angled members which are pivotally attached to said upright members, and which pivot when said chair is moved from said upright position to said reclining position.

7. The collapsible reclining chair of claim 1, wherein:

said reversible joint includes a pivot housing;

said collapsible reclining chair has an upper portion center of gravity; and each of said reversible joints is moveable from a first position to a second position, and in moving from said first position to said second position, said pivot housings move from a first vertical minimum at said first position through a vertical maximum to a second relative vertical minimum at said second position, such that once rotation of said reversible joints has moved said upper portion center of gravity so that it is on either side of said vertical maximum, the weight of the chair maintains the chair in one of the relative vertical minimums at first and second positions.

8. A collapsible reclining chair, comprising:

a frame assembly including a plurality of frame members, where said plurality of frame members are grouped into a plurality of scissor pairs which are joined near their midpoints by pivots;

ends of said frame members of said scissor pairs are joined at pivot assemblies to form an extended scissors-frame assembly, such that the frame assembly moves towards a central area from all sides as a unit when the frame is to be collapsed, and moves away from this central area when expanding;

said frame members include angled members and upright members, each of said upright members having a lower end;

a support surface having a back portion, said back portion being held in position by said upright members; and each of said upright members being attached to one of said angled members by a reversible joint, so that said reclining chair is movable from an upright position when said reversible joints are in a first position, to a reclining position when said reversible joints have been reversed to a second position, wherein each of said reversible joints include a pivot housing having first and second pivots, and said lower end of one of said upright members being pivotally attached to said first pivot of said pivot housing, said second pivot of said pivot housing being pivotally attached to one of said angled frame members.

9. The collapsible reclining chair of claim 8, wherein each of said reversible joints comprise:

an extension member having first and second ends;

a sleeve housing having a sleeve pivot, said sleeve housing being attached to one of said angled members;

a pivot housing having first and second pivots; and said lower end of one of said upright members being pivotally attached to said first pivot of said pivot housing, said first end of said extension member being pivotally attached to said second pivot of said pivot housing, said second end of said extension member being pivotally attached to said sleeve pivot of said sleeve housing.

10. The collapsible reclining chair of claim 8, further comprising a footrest.

11. The collapsible reclining chair of claim 8, further comprising armrests.

12. The collapsible reclining chair of claim 11, wherein:

said armrests are pivotally attached to said upright members and which pivot when said chair is moved from said upright position to said reclining position so that they remain roughly horizontal.

13. The collapsible reclining chair of claim 8, further comprising:

upper angled members which are pivotally attached to said upright members, and which pivot when said chair is moved from said upright position to said reclining position.

14. The collapsible reclining chair of claim 8, wherein:

said reversible joint includes a pivot housing;

said collapsible reclining chair has an upper portion center of gravity; and each of said reversible joints is moveable from a first position to a second position, and in moving from said first position to said second position, said pivot housings move from a first vertical minimum at said first position through a vertical maximum to a second relative vertical minimum at said second position, such that once rotation of said reversible joints has moved said upper portion center of gravity so that it is on either side of said vertical maximum, the weight of the chair maintains the chair in one of the relative vertical minimums at first and second positions.

15. A frame for a collapsible reclining chair, comprising:

a plurality of angled frame members, said angled frame members having upper ends and lower ends, the upper ends of said angled frame members being pivotally attached to upper connectors, and the lower ends being pivotally attached to feet, such that said frame assembly as a whole expands outwardly from a central area;

upright members, each of said upright members having a lower end;

a support surface, having a back portion, said back portion being held in position by said upright members; and each of said upright members being attached to one of said angled members by a reversible joint, so that said reclining chair is movable from an upright position when said reversible joints are in a first position, to a reclining position when said reversible joints have been reversed to a second position, wherein each of said reversible joints include a pivot housing having first and second pivots and said lower end of one of said upright members being pivotally attached to said first pivot of said pivot housing, said second pivot of said pivot housing being pivotally attached to one of said angled frame members.

16. The frame of claim 15, wherein each of said reversible joints comprise:

an extension member having first and second ends;

a sleeve housing having a sleeve pivot, said sleeve housing being attached to one of said angled members;

a pivot housing having first and second pivots; and said lower end of one of said upright members being pivotally attached to said first pivot of said pivot housing, said first end of said extension member being pivotally attached to said second pivot of said pivot housing, said second end of said extension member being pivotally attached to said sleeve pivot of said sleeve housing.

17. The frame of claim 15, wherein:

said reversible joint includes a pivot housing;

said frame has an upper portion center of gravity; and each of said reversible joints is moveable from a first position to a second position, and in moving from said first position to said second position, said pivot housings move from a first vertical minimum at said first position through a vertical maximum to a second relative vertical minimum at said second position, such that once rotation of said reversible joints has moved said upper portion center of gravity so that it is on either side of said vertical maximum, the weight of the chair maintains the chair in one of the relative vertical minimums at first and second positions.

18. A frame for a collapsible reclining chair, comprising:

a plurality of frame members, where said plurality of frame members are grouped into a plurality of scissor pairs which are joined near their midpoints by pivots;

ends of said frame members of said scissor pairs are joined at pivot assemblies to form an extended scissors-frame assembly, such that the frame assembly moves towards a central area from all sides as a unit when the frame is to be collapsed, and moves away from this central area when expanding;

said frame members including angled members and upright members, each of said upright members having a lower end;

a support surface, having a back portion, said back portion being held in position by said upright members; and said lower ends of each of said upright members being attached to one of said angled members by a reversible joint, so that said reclining chair is movable from an upright position when said reversible joints are in a first position, to a reclining position when said reversible joints have been reversed to a second position, wherein each of said reversible joints include a pivot housing having first and second pivots, and said lower end of one of said upright members being pivotally attached to said first pivot of said pivot housing, said second pivot of said pivot housing being pivotally attached to one of said angled frame members.

19. The frame of claim 18, wherein each of said reversible joints comprise:

an extension member having first and second ends;

a sleeve housing having a sleeve pivot, said sleeve housing being attached to one of said angled members;

a pivot housing having first and second pivots; and said lower end of one of said upright members being pivotally attached to said first pivot of said pivot housing, said first end of said extension member being pivotally attached to said second pivot of said pivot housing, said second end of said extension member being pivotally attached to said sleeve pivot of said sleeve housing.

20. The frame of claim 18, wherein:

said reversible joint includes a pivot housing;

said frame has an upper portion center of gravity; and each of said reversible joints is moveable from a first position to a second position, and in moving from said first position to said second position, said pivot housings move from a first vertical minimum at said first position through a vertical maximum to a second relative vertical minimum at said second position, such that once rotation of said reversible joints has moved said upper portion center of gravity so that it is on either side of said vertical maximum, the weight of the chair maintains the chair in one of the relative vertical minimums at first and second positions.

21. A collapsible reclining chair, comprising:

a frame assembly including a plurality of frame members, where said plurality of frame members are grouped into a plurality of scissor pairs which are joined near their midpoints by pivots;

ends of said frame members of said scissor pairs are joined at pivot assemblies to form an extended scissors-frame assembly, such that the frame assembly moves towards a central area from all sides as a unit when the chair is to be collapsed, and moves away from this central area when expanding;

said frame assembly further including upright members, each of said upright members having a lower end;

a support surface, having a back portion, said back portion being held in position by said upright members;

said collapsible reclining chair has an upper portion center of gravity;

said lower ends of each of said upright members being attached to one of said angled members by a reversible joint, said reversible joint including a pivot housing having first and second pivots, said lower end of one of said upright members being pivotally attached to said first pivot of said pivot housing, said second pivot of said pivot housing being pivotally attached to one of said angled frame member so that said reclining chair is movable from an upright position when said reversible joints are in a first position, to a reclining position when said reversible joints have been reversed to a second position, and in moving from said first position to said second position, said pivot housings move from a first vertical minimum at said first position through a vertical maximum to a second relative vertical minimum at said second position, such that once rotation of said reversible joints has moved said upper portion center of gravity so that it is on either side of said vertical maximum, the weight of the chair maintains the chair in one of the relative vertical minimums at first and second positions.

22. A collapsible reclining chair, comprising:

a frame assembly including a plurality of angled frame members, said angled frame members having upper ends and lower ends, the upper ends of said angled frame members being pivotally attached to upper connectors, and the lower ends being pivotally attached to feet, such that said frame assembly as a whole expands outwardly from a central area;

said frame assembly further including upright members, each of said upright members having a lower end;

a support surface, having a back portion, said back portion being held in position by said upright members; and said lower ends of each of said upright members being attached to one of said angled members by a reversible joint, so that said reclining chair is movable from an upright position when said reversible joints are in a first position, to a reclining position when said reversible joints have been reversed to a second position, wherein said reversible joint includes a pivot housing, said collapsible reclining chair has an upper portion center of gravity, and each of said reversible joints is moveable from a first position to a second position, and in moving from said first position to said second position, said pivot housings move from a first vertical minimum at said first position through a vertical maximum to a second relative vertical minimum at said second position, such that once rotation of said reversible joints has moved said upper portion center of gravity so that it is on either side of said vertical maximum, the weight of the chair maintains the chair in one of the relative vertical minimums at first and second positions.

23. The collapsible reclining chair of claim 22, further comprising a footrest.

24. The collapsible reclining chair of claim 22, further comprising armrests.

25. The collapsible reclining chair of claim 24, wherein:

said armrests are pivotally attached to said upright members and which pivot when said chair is moved from said upright position to said reclining position so that they remain roughly horizontal.

26. The collapsible reclining chair claim 22, further comprising:

upper angled members which are pivotally attached to said upright members, and which pivot when said chair is moved from said upright position to said reclining position.

27. A collapsible reclining chair, comprising:

a frame assembly including a plurality of frame members, where said plurality of frame members are grouped into a plurality of scissor pairs which are joined near their midpoints by pivots;

ends of said frame members of said scissor pairs are joined at pivot assemblies to form an extended scissors-frame assembly, such that the frame assembly moves towards a central area from all sides as a unit when the frame is to be collapsed, and moves away from this central area when expanding;

said frame members include angled members and upright members, each of said upright members having a lower end;

a support surface having a back portion, said back portion being held in position by said upright members; and each of said upright members being attached to one of said angled members by a reversible joint, so that said reclining chair is movable from an upright position when said reversible joints are in a first position, to a reclining position when said reversible joints have been reversed to a second position, wherein said reversible joint includes a pivot housing, said collapsible reclining chair has an upper portion center of gravity, and each of said reversible joints is moveable from a first position to a second position, and in moving from said first position to said second position, said pivot housings move from a first vertical minimum at said first position through a vertical maximum to a second relative vertical minimum at said second position, such that once rotation of said reversible joints has moved said upper portion center of gravity so that it is on either side of said vertical maximum, the weight of the chair maintains the chair in one of the relative vertical minimums at first and second positions.

28. The collapsible reclining chair of claim 27, wherein each of said reversible joints comprise:

a pivot housing having first and second pivots; and said lower end of one of said upright members being pivotally attached to said first pivot of said pivot housing, said second pivot of said pivot housing being pivotally attached to one of said angled frame members.

29. The collapsible reclining chair of claim 27, further comprising a footrest.

30. The collapsible reclining chair of claim 27, further comprising armrests.

31. The collapsible reclining chair of claim 30, wherein:

said armrests are pivotally attached to said upright members and which pivot when said chair is moved from said upright position to said reclining position so that they remain roughly horizontal.

32. The collapsible reclining chair of claim 27, further comprising:

upper angled members which are pivotally attached to said upright members, and which pivot when said chair is moved from said upright position to said reclining position.

33. A frame for a collapsible reclining chair, comprising:

a plurality of frame members, where said plurality of frame members are grouped into a plurality of scissor pairs which are joined near their midpoints by pivots;

ends of said frame members of said scissor pairs are joined at pivot assemblies to form an extended scissors-frame assembly, such that the frame assembly moves towards a central area from all sides as a unit when the frame is to be collapsed, and moves away from this central area when expanding;

said frame members including angled members and upright members, each of said upright members having a lower end;

a support surface, having a back portion, said back portion being held in position by said upright members; and said lower ends of each of said upright members being attached to one of said angled members by a reversible joint, so that said reclining chair is movable from an upright position when said reversible joints are in a first position, to a reclining position when said reversible joints have been reversed to a second position, wherein said reversible joint includes a pivot housing, said frame has an upper portion center of gravity, and each of said reversible joints is moveable from a first position to a second position, and in moving from said first position to said second position, said pivot housings move from a first vertical minimum at said first position through a vertical maximum to a second relative vertical minimum at said second position, such that once rotation of said reversible joints has moved said upper portion center of gravity so that it is on either side of said vertical maximum, the weight of the chair maintains the chair in one of the relative vertical minimums at first and second positions.

34. The frame of claim 33, wherein each of said reversible joints comprise:

a pivot housing having first and second pivots; and said lower end of one of said upright members being pivotally attached to said first pivot of said pivot housing, said second pivot of said pivot housing being pivotally attached to one of said angled frame members.

* * * * *